United States Patent [19]

Chen

[11] 4,303,110

[45] Dec. 1, 1981

[54] TOOTHPASTE DISPENSER

[76] Inventor: Jason K. S. Chen, No. 17, La. 541, Sung Shen Rd., Taipei, Taiwan

[21] Appl. No.: 100,275

[22] Filed: Dec. 5, 1979

[51] Int. Cl.[3] ..... B65B 3/04

[52] U.S. Cl. ..... 141/362; 141/98; 141/284; 222/71

[58] Field of Search ..... 141/346–362, 141/250–284, 98; 222/71

[56] References Cited

U.S. PATENT DOCUMENTS 4,178,975 12/1979 Crespi ..... 141/362

*Primary Examiner*—Houston S. Bell, Jr.
*Attorney, Agent, or Firm*—Tak Ki Sung

[57] ABSTRACT

A dispenser for drawing toothpaste from a squeeze-tube container and applying it to the top of a toothbrush with a vacuum pump of piston-cylinder construction which is so operated that the pump draws the toothpaste out of the squeeze-tube container when the toothbrush is pushed into the dispenser and discharges the same when the toothbrush is withdrawn. The toothpaste is pumped through a passage which is provided with an inlet valve which operates in cooperation with an elastic adapter used for mounting and sealing the neck portion of the squeeze-tube container, an outlet valve which operates in cooperation with a port formed in the cylinder, and an elastic discharge nozzle which opens when the toothpaste is being pumped and closes by its own resiliency when the toothpaste is being drawn out of the squeeze-tube container. The amount of toothpaste supplied each time by the dispenser can be adjustably predetermined as desired.

4 Claims, 5 Drawing Figures

TOOTHPASTE DISPENSER

BACKGROUND OF THE INVENTION

This invention relates to a dispenser for drawing toothpaste from a squeeze-tube container and applying it to the top of a toothbrush with a vacuum pump of piston-cylinder construction, more particularly to a toothpaste dispenser with a vacuum pump of piston-cylinder construction whose discharge capacity can be adjustably predetermined.

The applicant is aware of the prior art proposed in Japanese Patent No. 50-3950 published in 1975 which discloses a dispenser for thick liquid material comprising a vacuum pump of piston-cylinder construction, a lever mechanism hinged to the piston thereof, a passageway for thick liquid material formed therein with the discharge port formed vertically downward, an inlet valve of ball type operating in direct contact with the end surface of the neck portion of the container, and an outlet valve formed integrally with the cylinder body.

Such a prior proposed dispenser may suffer from serveral disadvantages such as, for example, a rather imperfect sealing of the inlet valve because of the direct contact of the valve member with the end surface of the neck portion of the container of thick liquid material which by its nature is not intended to perform a valve function and the end surface of the neck portion may not be smooth enough to achieve the purpose of sealing when the valve is closed. Another disadvantage is that a rather incomplete construction of a piston-cylinder combination is formed which may lead to the leakage of the thick liquid material. A further disadvantage is an improperly arranged, vertically downward discharge port which tends to leave residuals of thick liquid material after the use of the dispenser. The leaks and residuals of thick liquid material not only waste the material but leaves the area around the apparatus messy, thus increasing the need for frequent cleaning.

SUMMARY OF THE INVENTION

In view of the aforesaid disadvantages or problems, the present invention discloses an improved toothpaste dispenser comprising a vacuum pump of piston-cylinder type with the piston provided with an elastic sealing sleeve, a mounting base formed with a passage in which an inlet valve of leaf type is provided to operate in cooperation with an elastic adapter for mounting and sealing the neck portion of the squeeze-tube container of toothpaste, an actuator connected to the end of the piston rod, and a supply amount adjusting bracket. The cylinder is formed with a discharge chamber in which an outlet valve is provided to operate in cooperation with the outlet port formed in the cylinder, and a cylinder chamber in which the piston is slidably inserted. An elastic discharge nozzle is provided at the end of discharge chamber and fastened with a sleeve nut.

The toothpaste is drawn into the cylinder chamber through an inlet valve, and discharged through an outlet valve, discharge chamber and the discharge nozzle that are arranged horizontally in line with the axis of the cylinder. The actuater connected to the piston rod is urged by a coil spring and normally kept in position at the end of a discharge stroke. The drawing, or suction, of the toothpaste is performed when the toothbrush is inserted through the opening in the front side of the mounting base to push the actuator inward, and the discharge of toothpaste is performed when the toothbrush is withdrawn and the actuator is pushed back outwardly by the spring. The stroke of the actuator can be adjustably predetermined by properly setting the supply amount adjusting bracket provided in the vicinity of the end of the inward stroke of the actuator so that the amount of toothpaste to be discharged each time can be adjusted as desired beforehand.

The main object of this invention is to provide an improved toothpaste dispenser which can supply a fixed amount of toothpaste to the toothbrush by a simple operation of pushing in and taking out the toothbrush.

Another object of this invention is to provide an improved toothpaste dispenser which cuts wastage from leaks, residuals or dripping.

Still another object of this invention is to provide an improved toothpaste dispenser with which the amount of toothpaste supplied each time can be adjustably predetermined.

DETAILED DESCRIPTION OF THE INVENTION

In order that this invention may be more readily understood, and so that the further features thereof may be appreciated, a particular embodiment of the toothpaste dispenser according to the invention will now be described with reference to the accompanying drawings in which.

Figure 1:
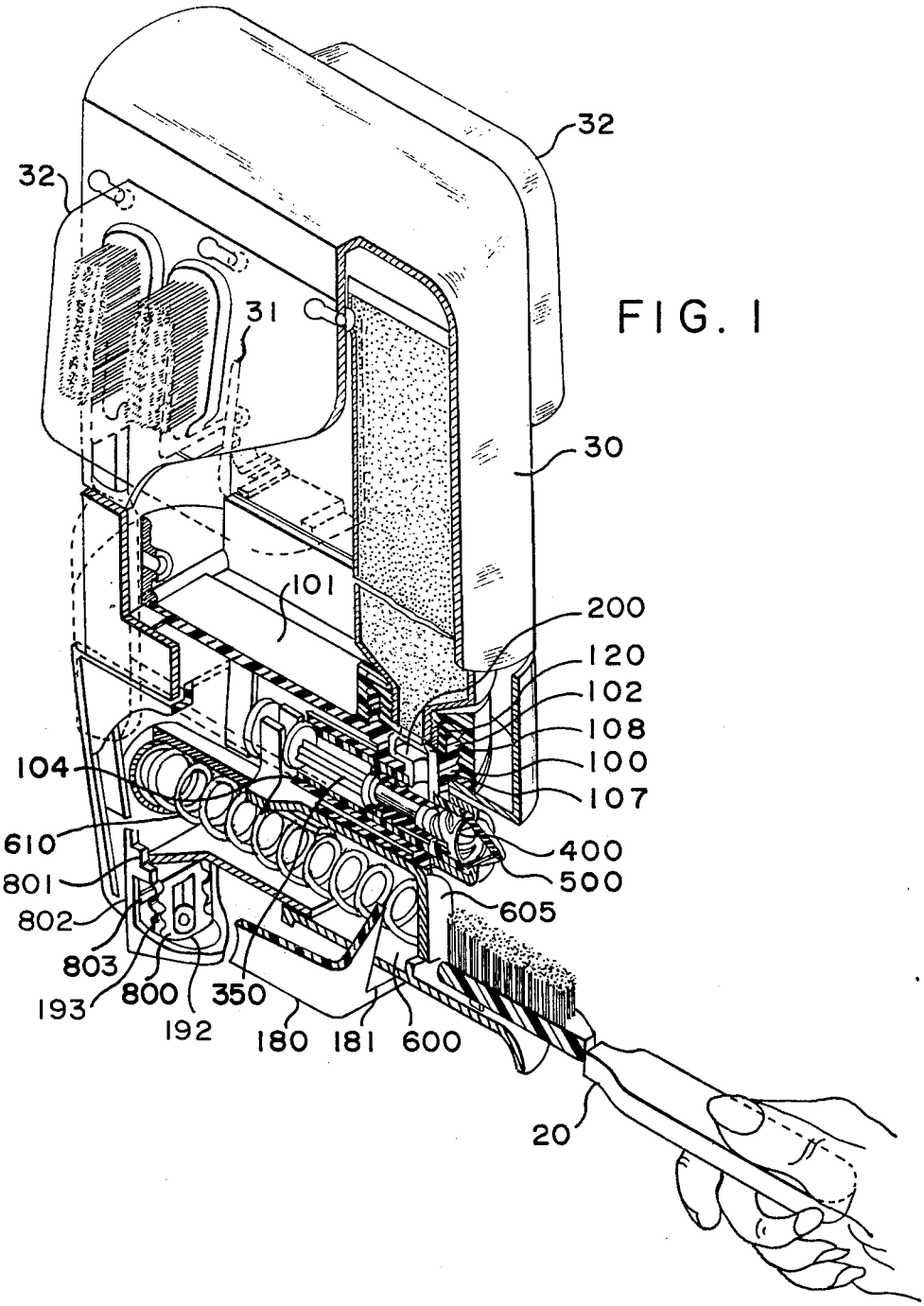
FIG. 1 is a partial cut-away, perspective, sectional view of the toothpaste dispenser in accordance with the invention.

Referring now to the drawings, mounting base (100) is made of molded plastic, having a mounting plate (101) integrally formed therewith, a cylindrical upper boss (102) integrally formed with its axis vertically on the top side near the front end of said mounting plate (101), a base body (103) integrally formed on the bottom side near the front end of said mounting plate (101), said base body (103) being formed with a horizontal hole (104) whose front portion (105) has a larger diameter than that of the rear portion (106). The cylindrical upper boss (102) is formed with screw threads (108) on the outer peripheral surface and is also formed with a cylindrical cavity towards the bottom thereof, a cylindrical recess (109) at the bottom and another cylindrical recess (110) at the further bottom thereof. Between the front portion (105) of the horizontal hole (104) and the hollow portion of said recess (110) a passage (107) is formed; the axis of said passage is off the axis of said recesses (109), (110) and said cylindrical upper boss so that the inlet valve (200) having a lower tube portion (202) of eccentric center axis can be placed in position without rotational movement. Said mounting base (100)

is further formed with lower case (180) as an integral part thereof, said lower case (180) being connected integrally to the front side of said base body (103) and having a front opening (181) formed on the front side thereof below the front side of said base body (103).

The adapter (120) is made of elastic material such as rubber in a cylinderical shape with the outer diameter approximately the same as the inner diameter of said cylindrical upper boss (102). Said adapter (120) is formed with a flange (123) protruding radially and outwardly on the top thereof, and a cylindrical flange (122) protruding axially, upwardly and slightly inwardly at the periphery of the upper end of the hollow portion of the diameter approximately the same as the outer diameter of the neck portion (11) of the squeeze-tube container (10) of the toothpaste. The bottom portion of said adapter (120) is formed with an inlet port (121) of diameter smaller than that of the hollow portion above. Said adapter (120) is inserted in said cylindrical upper boss (102) with the neck portion (11) of the squeeze-tube container (10) invertedly inserted in the hollow portion of said adapter (120) and is fastened tightly with a sleeve nut (150) to said cylindrical upper boss (102). The flanges (122), (123) are thus pressed to form an airtight joint, and the end surface (13) of the neck portion (11) of the squeeze-tube container (10) is pressed against the bottom of the adapter to form another airtight joint.

Figure 2:
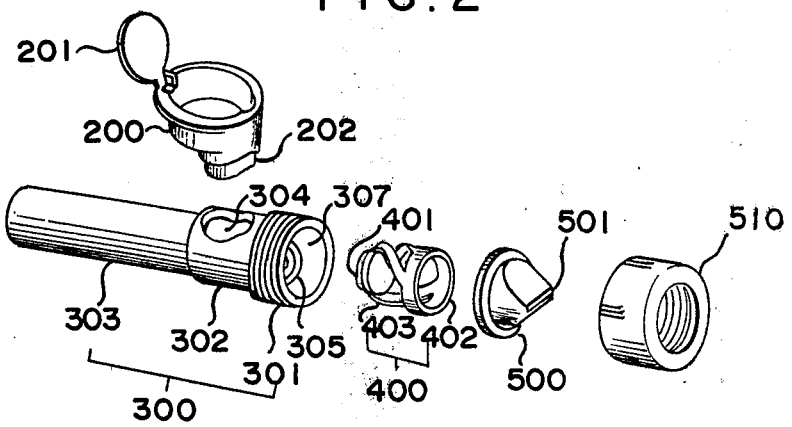
FIG. 2 is an oblique, exploded view of the major components of the toothpaste dispenser in accordance with the invention.

The inlet valve (200), as shown in FIG. 2, is made of molded plastic, comprising a valve leaf (201), a cylindrical valve body and a lower tube portion (202) formed integrally in one unit, said valve leaf (201) being molded at the periphery of said cylindrical valve body and being capable of swinging with resiliency with respect to the molded connection thereof, said lower tube portion (202) being formed with its own axis off the axis of said cylindrical valve body so that said inlet valve (200) is placed in the aforesaid recesses (109) and (110) and said lower tube portion (202) is inserted in said passage (107) correspondingly. Said inlet valve (200) is so arranged, that said valve leaf (201) comes in contact with the bottom surface of said adapter to close said inlet port (121) when it swings up, and open when it swings down so as to allow flow of the toothpaste in only the direction from the container to the cylinder. Furthermore, as said inlet valve (200) is put in place with its eccentric low tube portion (200) inserted in the passage (107), undesirable rotational movement is prevented positively.

The cylinder (300) is made of molded plastic, having the head portion (301) formed with screw threads on the outer peripheral surface thereof, the mid portion (302) with an outer diameter slightly larger than that of the cylinder body portion (303), said mid portion (302) being formed with a hole (304) in the upper wall. Said cylinder is inserted into the horizontal hole (104) in such a manner that said mid portion (302) fits the front portion (105) and said cylinder body portion (303) fits the rear portion of said horizontal hole (104) correspondingly, such that said head portion (301) protrudes outwardly from the front surface of the base body (103). The low tube portion (202) of said inlet valve (200) is so arranged to further extend into said hole (304) of said cylinder (300) and thus said cylinder (300) is positively positioned.

The outlet valve (400) is made of molded plastic, having a valve disc member (401), a resilient support member (403) formed in helical shape and a supporting ring (402) molded integrally in one unit, said resilient support member (403) being capable of compression when forced and expansion when the force is removed in axial direction. The outlet valve (400) is disposed in the discharge chamber (307) so that the valve disc member (401) is normally urged by the resilient support member (403) to close the outlet port (306) formed in the cylinder (300) and is allowed to move axially to open said outlet port (306) when forced by the outgoing toothpaste.

The discharge nozzle (500) is made of elastic material such as rubber in such a shape as shown in FIG. 2. The discharge nozzle is formed with a discharge port (501) of slit type which is normally closed by its own resiliency. When pressure is applied from within to expand the nozzle (500), the discharge port (501) opens, and when the pressure is removed as in the drawing or suction stroke, the discharge port (501) closes again by its own resiliency. The discharge nozzle is mounted at the front end of the cylinder (300) with a sleeve nut (570).

Figure 3:
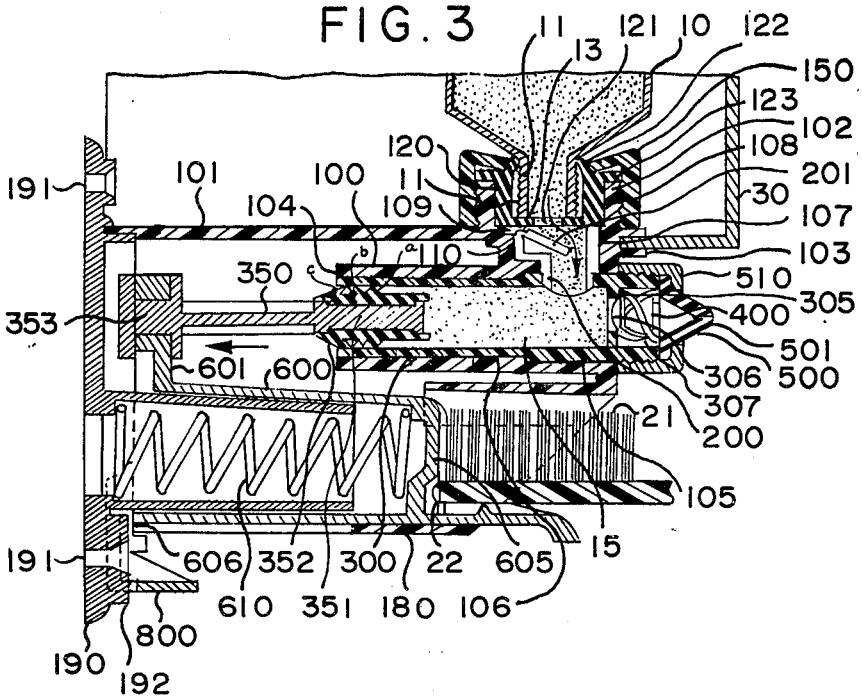
FIG. 3 is a longitudinal, sectional view of the toothpaste dispenser, showing the passage of toothpaste and the valves with the piston nearly at the end of the drawing or suction stroke.
Figure 4:
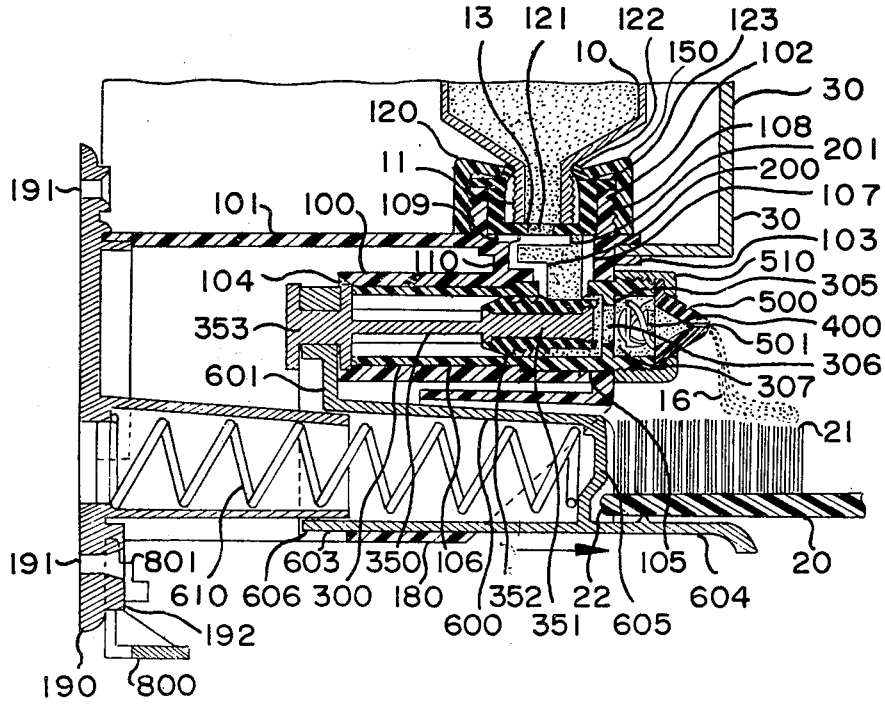
FIG. 4 is a longitudinal, sectional view of the toothpaste dispenser, showing the passage of toothpaste and values with the piston nearly at the end of pumping or discharge stroke.

The piston (350) is made of molded plastic, having an elastic sleeve (352) securely mounted around the surface of the piston portion, said sleeve (352) being formed on the surface with a plurality of V shaped projections in ring shaped construction around the axis thereof. In the particular embodiment three projections a, b and c are formed as shown in FIG. 3, said projections being provided to seal the passage between the piston and cylinder to assure the perfect functioning of the drawing and discharge operations.

The piston (350) is so arranged that it is slidably inserted into the cylinder (300) with the end of piston rod portion protruding towards the rear end of the cylinder, the end of the piston rod portion being provided with a connection neck portion (353) where the extension portion (601) provided at the rear portion of an actuator (600) to be described below is connected.

The actuator (600) is made of molded plastic or sheet metal in a semi-cylindrical shape, having the bottom portion (603) extending toward the front side to form the toothbrush holder (604), and a stopper (605) formed to receive the round end (22) of the tooth brush (20). The actuator (600) is disposed underneath the base body (103) with the rear portion connected to the rear end of the piston rod portion of the piston (350) as described above, and is guided by the side and bottom panels of the lower case (180) so that it is capable of moving forward and backward in the lower case (180). A coil spring (610) is provided in the hollow portion of said actuator (600) with one end supported by a portion of the mounting bracket (190) and the other end in contact with the backside of said stopper (605) of the actuator (600) to urge the actuator (600) towards the front of the base body (103).

The aforesaid mounting base (100) is attached to the mounting bracket (190) with the rear edges of the mounting base (100) inserted into the grooves formed on the surface of said bracket (190), and is joined thereto with a conventional joining compound such as epoxy glue. The bracket is provided with screw mounting holes (191) for mounting the whole dispenser on a proper place such as bathroom wall.

Figure 5:
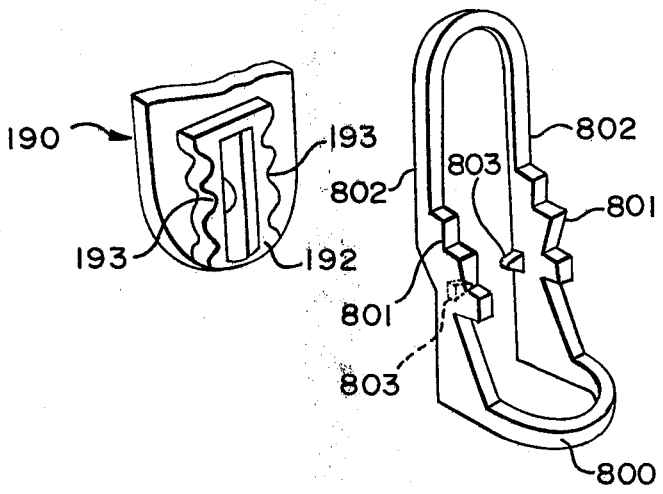
FIG. 5 is an enlarged, oblique view of the toothpaste supply amount adjusting bracket in accordance with the invention.

The toothpaste supply amount adjusting bracket (800) is formed of molded plastic as shown in FIG. 5 in a shape of elongated loop, having a plurality of steps (801) in suitable height increments provided on each of the side members (802), and a latch (803) protruding inwardly toward each other on each of the side members (802). The toothpaste supply amount adjusting bracket (800) is mounted on a projection (192) formed on the lower portion of the mounting bracket (190), the projection (192) having a plurality of notches (193) formed on each of the two sides. The toothpaste supply amount adjusting bracket (800) is held in position by latches (803) which selectively engage with said notches (193). By pulling said toothpaste supply amount adjusting bracket (800) vertically upwardly or downwardly along the surface of the mounting bracket (190), the two side members (802) are forced to expand outwardly by the wedge effect between the latches (803) and the notches (193) and thus the latches (803) are disengaged from the notches (193) and moved to come in engagement with next notches by the resiliency of the toothpaste supply amount adjusting bracket (800) itself.

The toothpaste supply amount adjusting bracket (800) is arranged in the vicinity of the rear end of the actuator (600) towards the end of the inward stroke so that the stroke of the actuator is determined when the rear end of the actuator (600) hits one of the plurality of steps (801) formed on the toothpaste supply amount adjusting bracket (800), and thus determining the amount of toothpaste drawn to the cylinder. By pulling said toothpaste supply amount adjusting bracket (800) upwardly or downwardly to change its position in relation with the projection (192) as described above the step which the end of the actuator (800) hits is changed from one height to the other and thus the stroke is changed, and consequently the amount of toothpaste drawn to the cylinder, or supplied to the toothbrush, is changed.

The particular embodiment of the toothpaste dispenser according to this invention is further provided with an upper case (30) which is made of molded plastic and is detachably connected to the mounting base (100) with its lower edges engaged with the slot (not shown) formed on the upper surface of the mounting plate (101). The upper case (30) is arranged to conceal the toothpaste container (10) as mounted on the upper base (102), and is also provided with toothbrush hangers (31) capable of accommodating 4 or 5 toothbrushes on each side thereof. Each side of the upper case (30) is provided with a cover (32) detachably attached thereto with hook or snap-in joints, to form a toothbrush storage compartment. The covers (32) are made of molded plastic, preferably transparent, and are arranged to cover the brush portion of the toothbrushes stored thereon.

The operation of the embodiment according to this invention will now be described:

One of the toothbrushes stored on the hanger provided at the sides of the upper case (30) is taken and laid on the toothbrush holder (604), with the tip of the toothbrush laid against the stopper (605). The toothbrush is pushed into the front opening (181) and thus pushes the actuator (600) inwardly against the coil spring (610). The piston (350) is then pulled by the actuator (600) and by the extension rod (601) moves towards the rear end of the mounting base (100) and creates a vacuum in the cylinder (300). The leaf valve (201) of the inlet valve (200) then opens the port (121) as shown in FIG. 3, and the toothpaste is drawn from the tube container (10) into the interior of the cylinder (300). In the meantime the outlet valve disc (401) closes the outlet port (306) to maintain the vacuum in the interior of the cylinder (300).

As soon as the rear end of the actuator (600) hits the adjusting bracket (800), the backward movement of the piston (350) is stopped and the predetermined amount of toothpaste fills the cylinder (300).

Then the toothbrush is withdrawn and the actuator (600) is released from the pushing-in force and is then pushed forward by the coil spring (610) and the pressure is formed in the cylinder (300) by the forward movement of the piston (350). The inlet port (121) is then closed by the inlet valve leaf (201) and the outlet valve disc (401) is pushed by the toothpaste to open the outlet port (306). As the piston (350) continues to move forward by the force of the coil spring (610), the toothpaste in the cylinder (300) is discharged into the discharge chamber (307). The discharge nozzle is then opened by the pressure of the toothpaste and finally the toothpaste is supplied evenly to the toothbrush which is also moving outwardly. As soon as the piston (350) hits the outlet port (306), the forward movement of the piston (350) is stopped, pressure in the cylinder (300) and the discharge chamber (307) is relieved, and the outlet valve disc (401) is pushed by the resilient force of the helical support portion (403) to return to its originally closed position. In the meantime the discharge nozzle (500) is closed by its own resiliency without leaving residuals around the discharge nozzle.

In the case that a different amount of toothpaste is desired, the amount supplied can be selectively adjusted and predetermined by changing the position of the toothpaste supply amount adjusting bracket (800) as described previously.

It is readily apparent from the foregoing description that the toothpaste dispenser according to this invention is capable of supplying a preselected amount of tooth paste with simple operation of pushing the toothbrush into the dispenser and taking it out without leaving residuals in the area around the dispenser. Furthermore the toothpaste dispenser is provided with toothbrush storage compartments in one compact unit not only for easy access in use but also for better appearance as a bathroom utility unit.

The present invention may be embodied in other specific forms without departing from the spirit or essential characteristics thereof. It is to be understood that the scope of the invention is defined by the appended claims hereof.

What is claimed is:

1. A toothpaste dispenser comprising:

a mounting base having an upper recess for mounting a toothpaste container;

a horizontal hole formed in the upper portion of said mounting base;

an adaptor capable of sealing the toothpaste container to said mounting base;

a passage formed in between said recess and said horizontal hole;

a one-way valve disposed in said passage, said valve preventing toothpaste drawn into the passage from returning to said toothpaste container;

a cylinder having a front end, a rear end, and a discharge chamber formed in the front end, said cylinder being fixedly inserted in said mounting base and having an opening near the front end and upper surface thereof, said opening being aligned with said horizontal hole;

an outlet valve disposed in said discharge chamber;

a discharge nozzle mounted coaxially at the front end of the cylinder;

a piston slidably inserted in said cylinder and capable of creating a vacuum in the cylinder when said piston is moved towards the rear end of said cylinder and a positive pressure when moved towards the front end of the cylinder; and an actuator connected to said piston, a spring means being provided to urge said actuator towards the front end of said cylinder.

2. A toothpaste dispenser as recited in claim 1, wherein said outlet valve comprises a disc member provided with a helical shaped, resilient support member integrally formed therewith.

3. A toothpaste dispenser as recited in claim 1, wherein said discharge nozzle is made of a resilient material and is provided with a slit.

4. A toothpaste dispenser as recited in claim 1, wherein said mounting base is further provided with a bracket formed with a plurality of steps in suitable height increments adapted to selectively engage with said actuator when said actuator is moved towards the rear end of said cylinder, to selectively limit the movement of said piston.

* * * * *